US005235949A

United States Patent [19]

Wahl et al.

[11] Patent Number: 5,235,949

[45] Date of Patent: Aug. 17, 1993

[54] METHOD AND ARRANGEMENT FOR CONTROLLING THE FUEL METERED IN A DIESEL ENGINE

[75] Inventors: Josef Wahl, Stuttgart; Alf Löffler, Markgröningen-Talhausen; Hermann Grieshaber, Aichtal-Aich; Wilhelm Polach, Möglingen; Ewald Eblen; Joachim Tauscher, both of Stuttgart; Helmut Laufer, Gerlingen; Ulrich Flaig, Markgröningen; Johannes Locher, Stuttgart; Manfred Birk, Oberriexingen; Gerhard Engel, Stuttgart; Alfred Schmitt, Ditzingen; Pierre Lauvin, Francheville; Fridolin Piwonka, Markgröningen; Anton Karle, VS-Villingen; Hermann Kull, Stuttgart, all of Fed. Rep. of Germany

[73] Assignee: Robert Bosch GmbH, Stuttgart, Fed. Rep. of Germany

[21] Appl. No.: 558,299

[22] Filed: Jul. 26, 1990

[30] Foreign Application Priority Data

Aug. 4, 1989 [DE] Fed. Rep. of Germany ..... 3925877

[51] Int. Cl.[5] ..... F02D 31/00

[52] U.S. Cl. ..... 123/359; 123/358

[58] Field of Search ..... 123/357, 358, 359, 479

[56] References Cited

U.S. PATENT DOCUMENTS

| | | | |
|---|---|---|---|
| 4,223,654 | 9/1980 | Wessel | 123/358 |
| 4,515,125 | 5/1985 | Buck | 123/359 |
| 4,572,132 | 2/1986 | Piwonka | 123/359 |
| 4,669,436 | 6/1987 | Nanjyo | 123/359 |
| 4,730,586 | 3/1988 | Yamaguchi | 123/359 |
| 4,785,771 | 11/1988 | Ibuki | 123/359 |
| 4,791,900 | 12/1988 | Buck | 123/359 |
| 4,791,904 | 12/1988 | Grieshaber | 123/359 |
| 4,836,166 | 6/1989 | Wietelmann | 123/358 |
| 5,067,461 | 11/1991 | Joachim | 123/358 |

FOREIGN PATENT DOCUMENTS 3825138 4/1989 Fed. Rep. of Germany .

*Primary Examiner*—Carl S. Miller
*Attorney, Agent, or Firm*—Walter Ottesen

[57] ABSTRACT

The invention relates to a method and arrangement for preparing a fuel-metering signal M for a diesel engine starting with measured variables such as accelerator pedal position, rotational speed, lambda, exhaust gas temperature or torque. A fuel quantity request MW is pregiven in dependence upon the position of the accelerator pedal. This quantity request MW is supplied to a minimum selector together with a second signal. The output signal M of the minimum selector, in turn, determines the metered fuel. The second signal derives from a precontrol characteristic field 50 in dependence upon the speed. The output signal of the precontrol characteristic field MV is influenced by the controller output signal MR in specific operating conditions.

18 Claims, 6 Drawing Sheets

20
15
M
MW
30
40
+
+
54
56
MV
50
70
62
λI
λS
M
MV
MW
MR
60
MR
72
M
MW
MV
MR
λI
λS
74
+
-
76
DT
77
DT
78
λI
TA
Md
190
FP
n
QL
55
TW
SB
R
nL
PL
APR
λ
100
110
120
130
140
150
160
170
180
λI
n
Md
TW
QL
TL,PL

METHOD AND ARRANGEMENT FOR CONTROLLING THE FUEL METERED IN A DIESEL ENGINE

FIELD OF THE INVENTION

The invention relates to a method and arrangement for controlling the fuel metered in a diesel engine. The method starts with measured variables such as accelerator pedal position, rotational speed, lambda, exhaust gas temperature or torque. The method is carried out with a preselected desired fuel quantity dependent upon accelerator pedal position which is supplied to a minimum selection means together with a second signal. The output signal of the minimum selection means, in turn, determines the fuel metering. The invention also relates to an arrangement for performing the method.

BACKGROUND OF THE INVENTION

Such a method for controlling the metering of fuel for a diesel engine is disclosed in U.S. Pat. No. 5,067,461. In the method described in this application, the quantity of fuel to be injected in the part-load range is taken from multi-dimensional characteristic fields. The quantity of fuel to be metered to the engine is controlled with these values. In the full-load range, the output signal of a lambda probe is compared to a desired value. If the output signal of the lambda probe exceeds the pregiven desired value, then the quantity of fuel to be injected is correspondingly limited. The control has no influence on the quantity of fuel in the full-load range. This arrangement has the disadvantage that the control of the quantity of fuel is dependent only from the operational condition (start, idle, full-load, part-load) and from a few operating variables such as rotational speed, accelerator pedal position and the desired torque of the engine. Impermissible exhaust gas emissions can occur with this arrangement in specific operating conditions.

SUMMARY OF THE INVENTION

It is an object of the invention to minimize the occurring exhaust gas emissions for a method of controlling the metering of fuel in the manner described above. It is also an object of the invention to improve the dynamic of the engine while using the least amount of additional sensors.

The method of the invention is for making a fuel metering signal M available in a diesel engine starting with a measured variable such as accelerator pedal position, engine speed, lambda, exhaust gas temperature or torque. The method includes the steps of: providing a first signal indicative of a preselected fuel quantity request MW dependent upon accelerator pedal position; providing a second signal taken from a precontrol characteristic field 50 and dependent upon engine speed; applying the first and second signals to a minimum selector which, in turn, supplies an output signal M determining the metering of the fuel; and, influencing the second signal with the output signal MR of a controller with respect to a variable to be controlled during specific operating conditions.

The method and arrangement of the invention afford the advantage with respect to the state of the art that in specific operating ranges, the fuel quantity is only controlled while in other operating ranges, the precontrol values operate conjointly with the controller output signal on the fuel quantity.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
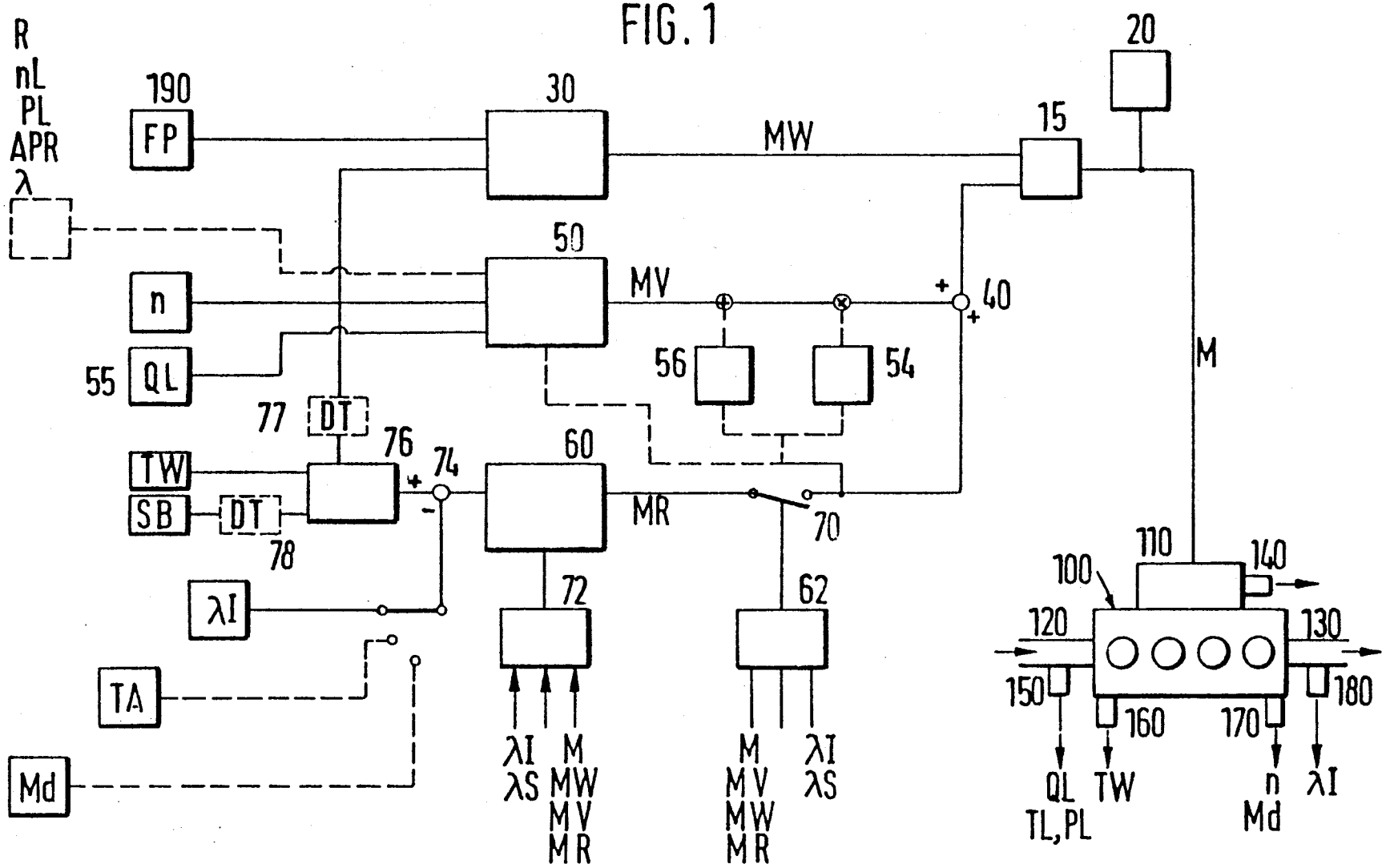
FIG. 1 is a block diagram of the arrangement of the invention for metering fuel to a diesel engine.

In FIG. 1, reference numeral 100 identifies a diesel engine which receives fuel via a fuel pump 110 and fresh air via an intake pipe 120. The exhaust gases are directed away via the exhaust gas line 130. Sensors 140 on the fuel pump 110 provide a signal SB which identifies the injection start or a fuel quantity signal MI which corresponds to the actual quantity of fuel injected. Sensors 150 are mounted in the intake pipe 120 and detect the following: the quantity of air QL drawn in by suction, the pressure PL and/or the temperature TL of the air drawn in by the engine. Sensors 160 on the engine detect such quantities as the cooling water temperature TW. Other sensors 170 detect the engine speed (n) or the torque Md. A lambda signal is obtained in the exhaust pipe by means of a sensor 180.

The quantity of fuel metered to the engine 100 is dependent essentially upon the output signal M of the minimum selector 15. A unit 20 generates an additional signal or a substitute signal for special operating conditions. The minimum selector 15 receives a signal from a driving-performance characteristic field 30 and a signal from a summing point 40. The output signal of the driving-performance characteristic field 30 is dependent essentially upon the rotational speed (n) and the accelerator-pedal position 190. The output signal of a road-speed controller could be utilized in lieu of the driving-performance characteristic field 30. The summation point 40 combines the output signals of a precontrol characteristic field 50 and a controller 60 with the output signal of the precontrol characteristic field 50 being additionally influenced by adaptive controllers (54, 56). An air quantity signal QL, a rotational speed signal (n) and possibly further variables are input variables for the precontrol characteristic field 50.

When the switch 70 is closed, the controller output signal MR reaches the summation point 40 and, via a switch 53, the adaptive controllers (54, 56) or the precontrol characteristic field 50. The position of the switch 70 is dependent upon the output of the control logic 62. The control parameters of the controller 60 can be adapted by means of a control parameter input 72 in dependence upon different operating parameters (control deviation, rotational speed and various quantity signals). The control deviation between the lambda desired value and the lambda actual value lying at the difference point 74 can serve as an input for the controller 60. The lambda desired value is identified by λS and the lambda actual value is identified by λI in the drawings. The lambda desired value derives from a desired-value input 76 which computes the desired value in dependence upon different variables such as rotational speed (n), cooling water temperature TW or injection start SB. It can be advantageous with respect to the foregoing to conduct those signals which characterize the rotational speed (n) and the injection start SB via respective DT-units (77, 78) for improving the control dynamic. The lambda actual value is measured by a lambda probe 180 mounted in the exhaust gas pipe 130.

In lieu of the lambda signal, an exhaust gas temperature signal TA or a torque signal Md can be controlled to a predetermined desired value. The input variables of the precontrol characteristic field then distinguish themselves in dependence upon the controlled variables.

The operation of the arrangement described above will now be explained. Fuel is metered to the engine 100 by the fuel pump 110 in correspondence to the measuring signal M. Generally, this quantity signal M is determined by the minimum selector means 15.

The unit 20 determines the fuel quantity M for specific operating conditions such as start and idle. The unit 20 also provides the following: smooth-running control; an emergency driving operation in the event of a malfunction; and, further functions which are not explained here in greater detail. The minimum selector 15 selects the smaller of the signals present at its two inputs. At one of its inputs, a quantity signal MW is present which characterizes the request of the driver. The request of the driver is pregiven by the accelerator-pedal transducer 190 or by means of a road-speed controller (not shown). The driving-performance characteristic field 30 supplies the quantity request MW in dependence upon the output signal of the accelerator-pedal transducer 190 and the rotational speed (n). A second quantity signal is present at the second output of the minimum selector 15 and this second quantity signal is put together from the output signals of the precontrol characteristic field 50 and the controller 60.

The precontrol characteristic field supplies a quantity signal MV in dependence upon the rotational speed (n) and the output signal QL of an air quantity detector 55. The air quantity detector 55 can be configured as an air-flow sensor or, as shown in FIG. 2, the air quantity QL can be computed with the aid of various variables. The output signal of the precontrol field 50 can be combined multiplicatively with the output signal of the adaptive controller 54 or additively with the output signal of the adaptive controller 56. This output signal of the precontrol characteristic field 50 operates continuously on the quantity signal M.

Without taking time to adjust, the precontrol effects a coarse adjustment of the fuel quantity M. The controller 60 is switched in only in specific operating conditions preferably at full load and then corrects the precontrol quantity MV. The output signal MR of the controller 60 is dependent upon the difference of the actual value and the output signal of the desired value input 76. This output signal MR determines the quantity signal M only when the switch 70 is closed, that is, when the controller 60 is switched in. A flowchart of the control logic 62 for driving the switch 70 is explained in greater detail with respect to FIG. 3.

An adaptation of the precontrol is possible by means of the superposed control loop. For this purpose, the output signal of the controller 60 is conducted to the inputs of the adaptive controllers (54 and 56) when the switch 70 is closed or this output signal can be conducted to a further input of the precontrol field 50. Since the lambda signal can be continuously detected, this signal is especially suitable for a rapid, simple adaptive control. The adaptive control prevents concentrations of exhaust and improves the engine elasticity. The adaptation balances out the influence of the fuel temperature. A fuel temperature sensor becomes unnecessary.

The adaptation of the precontrol values can take place in different ways. The output signal of the precontrol characteristic field can be multiplicatively corrected by means of the adaptive controller 54 and/or be additively corrected by means of the adaptive controller 56 in dependence upon the output signal MR of the controller 60.

The output signal of the controller MR reaches the adaptive controllers (54 or 56) in dependence upon the position of the switch 53. If the engine is driven in operational ranges in which additive errors are preferably effective, then the output signal of the controller 60 reaches the adaptive controller 56. This adaptive controller 56 determines then an additive variable and this variable is then added to the output signal MV of the precontrol characteristic field 50 in all operating ranges. This is then the case, for example, when only a small quantity of fuel is metered to the engine.

If, in contrast, the engine is driven in operating ranges wherein multiplicative errors are preferably effective, then the output signal of the controller 60 reaches the adaptive controller 54. This adaptive controller 54 then determines a multiplicative variable with which the output signal MV of the precontrol characteristic field 50 can be multiplied in all operating ranges. This is especially the case when a large quantity of fuel is metered to the engine.

In an especially advantageous embodiment of the invention, the output signal of the controller 60 can be conducted directly to the precontrol characteristic field 50. In this way, the values stored in the precontrol characteristic field 50 can be changed in dependence upon the controller output signal.

A good control dynamic can be obtained by superposing the lambda controller 60 on a precontrol. The reliability of the system is increased when a probe becomes defective since the precontrol remains continuously in use.

The output signal of the desired value input 76 is dependent essentially upon the rotational speed (n). The influence of engine warming on the composition of the exhaust gas can be corrected via the cooling water temperature TW or a corresponding measured variable. Furthermore, the influence of the injection start SB on the composition of the exhaust gas can be considered by detecting the injection start SB. The dynamic influence of rotational speed (n) and the injection start SB can be considered by means of DT-elements.

For low road speeds and especially for $v=0$, the desired value is displaced toward lower quantities or the control parameters are correspondingly changed. In this way, the condition is prevented that the speed climbs rapidly and impermissible exhaust emissions occur for the vehicle at standstill by actuating the accelerator pedal.

Figure 2A:
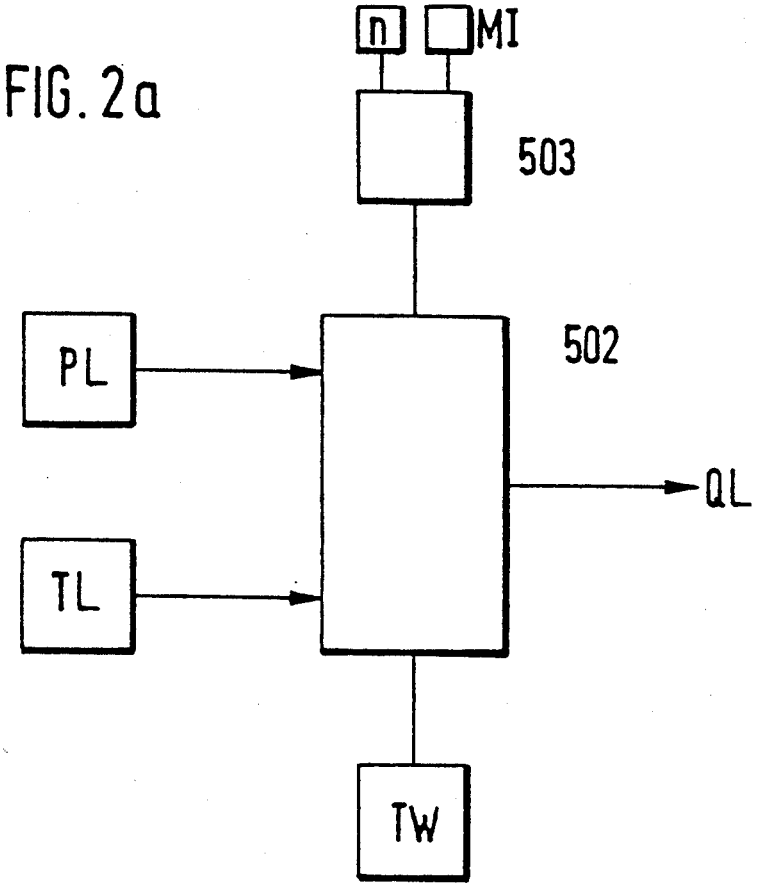
FIG. 2*a* shows a first possibility as to how the air quantity QL can be computed starting with different variables.

The speed signal (n) and a signal corresponding to the air quantity QL drawn in by suction are input variables for the precontrol characteristic field 50. FIG. 2 shows several possibilities for obtaining such a signal QL. In FIG. 2*a*, the air quantity QL in the intake pipe is computed by computer 502 from the pressure PL and the temperature TL. As the pressure PL, the absolute pressure or the differential pressure to air pressure can be utilized. A faster reaction of the control system occurs when the temperature signal TL of a slow temperature sensor is precontrolled in dependence upon the pressure signal PL.

The number of sensors can be reduced by not utilizing one of the sensors for the pressure or for the temperature. It is especially advantageous if only the air temperature TL is measured with a rapid sensor and the course of the pressure is derived from the measured course of the temperature. The steady-state start value of the derived pressure is formed via a characteristic field 503 in dependence upon rotational speed (n) and the injected fuel quantity MI. A correction of the base level of the air temperature which increases with engine warming is approximated via an available measurement of the cooling water temperature. The compression of the charging air leads rapidly to an increase of the temperature so that the error with respect to the actual charging pressure is insignificant.

Figure 2B:
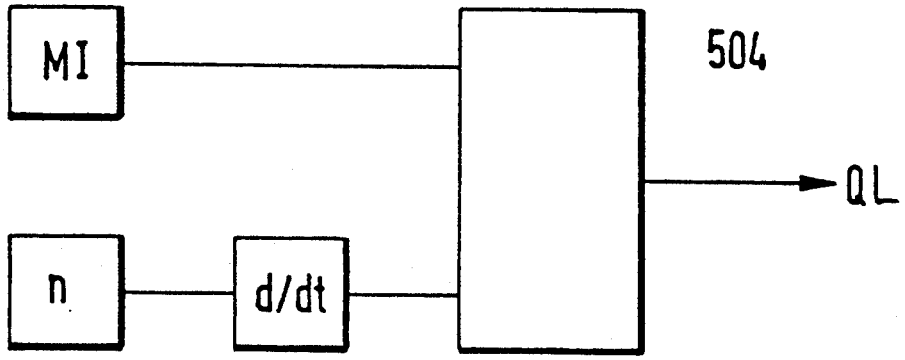
FIG. 2*b* shows a second possibility as to how the air quantity QL can be computed starting with different variables.

FIG. 2*b* shows a further possibility. The quantity of air drawn in by suction by the engine can be obtained by means of a simulation 504 from the injected quantity of fuel MI and the acceleration of the engine (the derivative of the speed (n) as a function of time). This simulation is only usable by means of the superposed lambda control since it, as a precontrol, requires only a limited accuracy.

Figure 3:
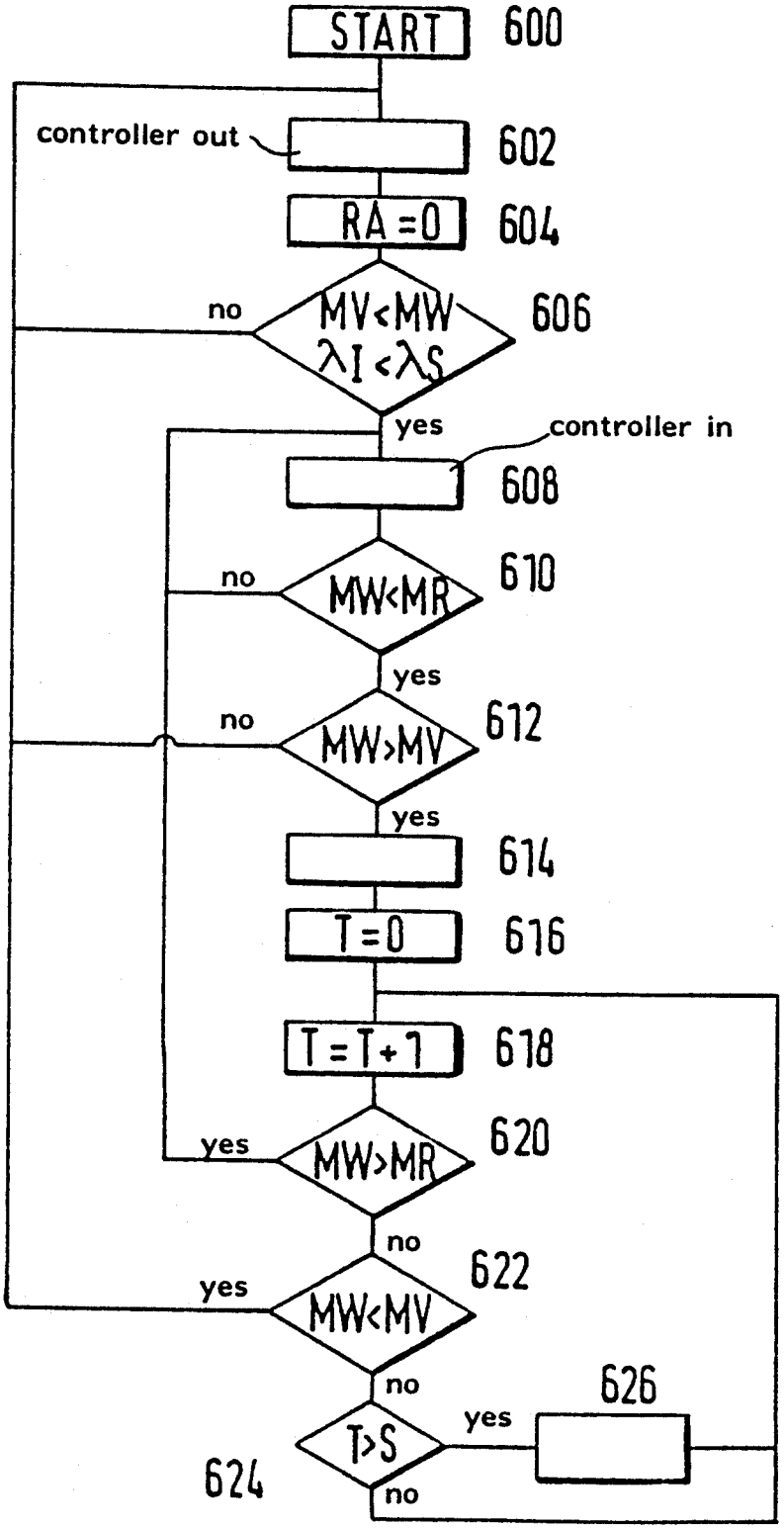
FIG. 3 is a flowchart of the control logic.

FIG. 3 shows a flowchart of the control logic 62. After the start 600 of the engine, the controller 60 is first switched out (602) and the switch 70 is open. The controller output signal RA has the value zero (604). The controller is switched in (608) and the switch 70 is closed if the quantity request MW (output signal of the driving-performance characteristic field 30) is greater than the output signal of the precontrol characteristic field MV and/or the lambda actual value is less than the lambda desired value (606).

The output signal of the controller RA is preserved (614) if the quantity request MW is less than the controller output signal MR (610) but is still greater than the output signal of the precontrol characteristic field MV (612). This means that the output signal of the controller is temporarily stored. The controller remains switched in (608) if the quantity request MW is greater than the controller output signal MR (610). If the quantity request is increased after a short time, the controller again becomes active with the preserved controller output signal (608) for a lambda actual value which is too rich.

If the actual quantity request is less than the controller output signal but greater than the output signal of the precontrol characteristic field, then a counter is set to zero (616) and is increased by one (618) in predetermined time intervals. If the inquiry 620 detects that the quantity request has increased in the meantime above the controller output signal MR, then the controller is again switched in (608). If the quantity request MW drops below the output signal MV of the precontrol characteristic field 622, then the controller is switched out (602) and the controller output RA is set to zero (604). If the counter does not exceed the threshold S, then it is again increased by one. If, in contrast, the counter exceeds the threshold S (624), then the preserved output signal is modified (626). A jump-free cutout occurs when the controller 60 is switched in by means of a follow-up control by the controller or by means of a computation of the particular initial value.

Figure 4:
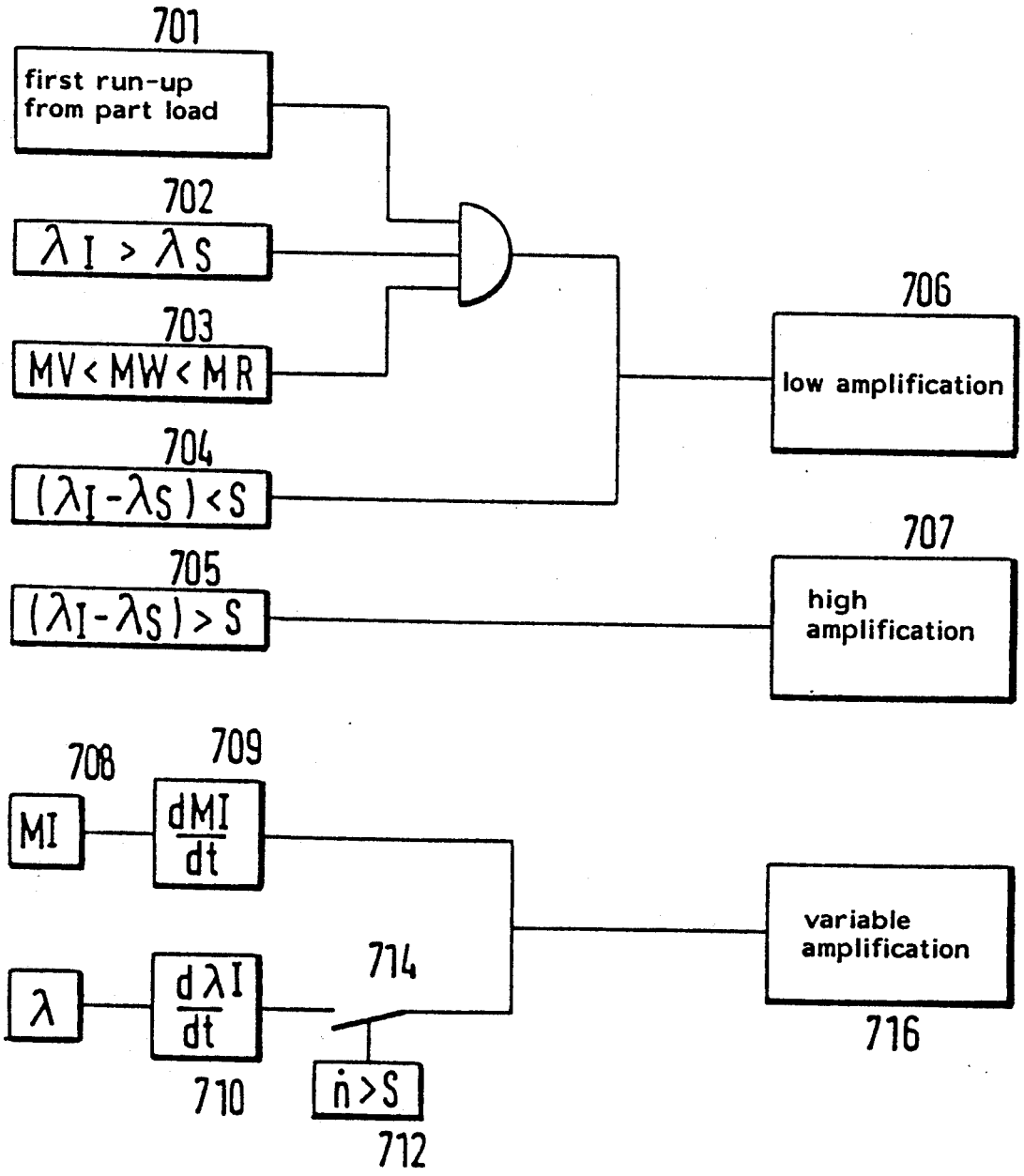
FIG. 4 is a block diagram which shows how the control parameters can be controlled.

The control parameters, that is the P-component and the I-component of the PI-controller can be controlled as shown in FIG. 4. Accordingly, an indented amplification characteristic of the controller in dependence upon the sign of the control deviation is especially advantageous. When running up from part-load (701), a different amplification is then especially advantageous as long as the measured lambda value is greater than the desired lambda value (702) (negative control deviation) and the quantity MR requested from the controller is less than the quantity MV supplied from the precontrol characteristic field. If the request quantity MW lies for the first time after part-load operation (701) between the value (703) determined from the precontrol characteristic field and the value determined from the lambda control, then a lower amplification (706) is selected for a careful approximation to the exhaust limit. Thereafter, a higher amplification is selected for positive as well as for negative control deviations.

The following modification is applicable for rapid controllers. A lower amplification is selected when a small control deviation (the difference of actual lambda value and desired lambda value is less than a threshold S 704) signals that only a small quantity may continue to come. A high amplification 707 is selected in all other cases. The acceleration performance is improved by means of increased amplification especially at a higher gear.

Furthermore, the following alternatives (with variable control parameters 716) are possible for influencing the control parameters. The control parameters can be coupled to the fuel quantity MI via a differential element 709. For acceleration, the derivative of the speed is greater than a threshold and the switch 714 is closed and the gradient 710 of the lambda signal influences the control parameters. The quantity increase by means of the precontrol is slower in a higher gear.

For a full-load jump, that is the quantity request increases very rapidly, an overshoot of the controller can occur which leads to an increased soot emission. This unwanted increased quantity is still further increased if the precontrol continues to demand an increasing quantity. This overshoot of the quantity of fuel to be injected is based on the dead time and the delay time of the control-loop segment. This can be obviated as will now be described. If the actual lambda value drops below the desired lambda value, then the output signal of the precontrol characteristic field can be supplied only with a delay when the precontrol demands an additional quantity.

Figure 5:
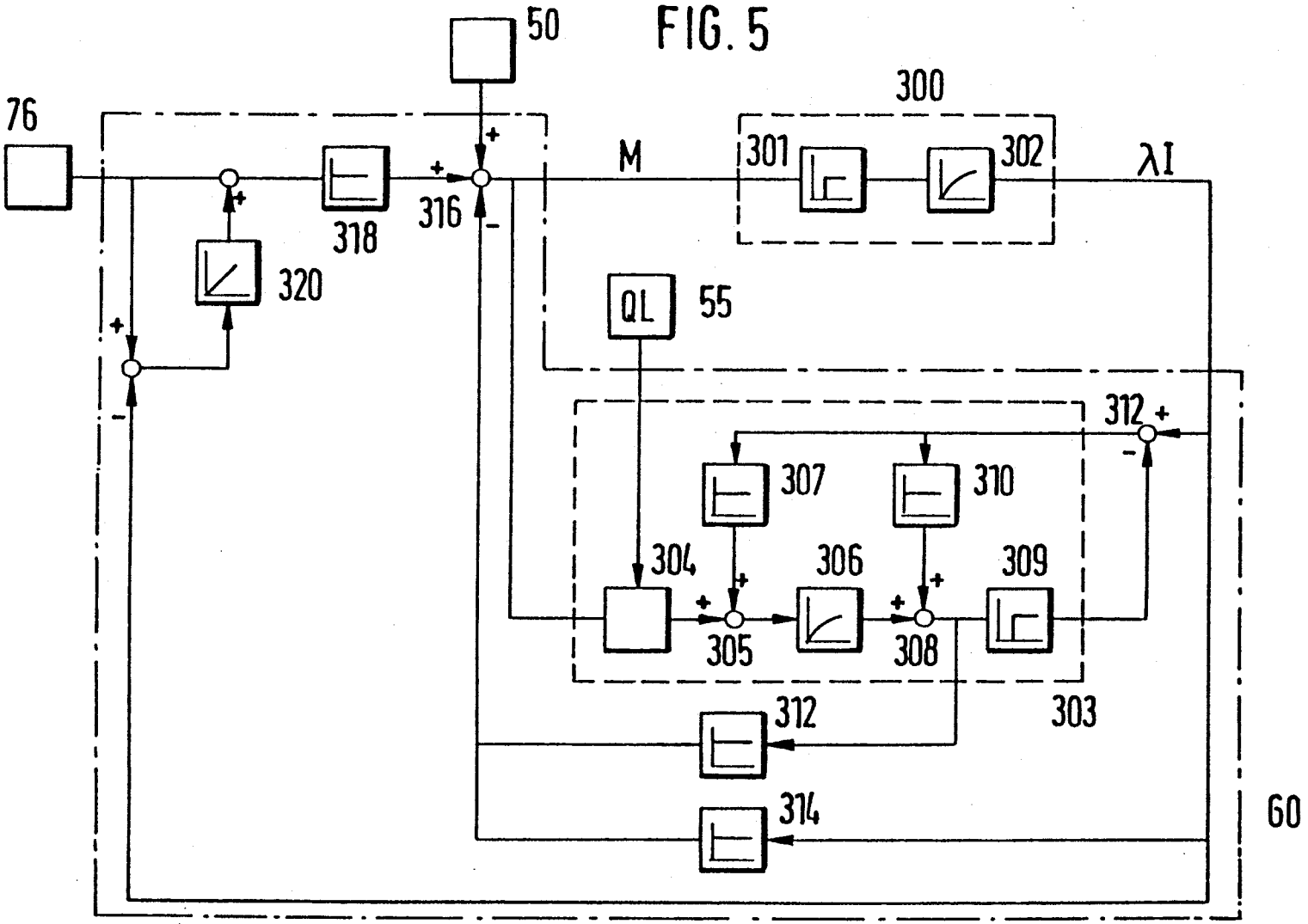
FIG. 5 is a block diagram showing an especially advantageous configuration of the controller 60 of FIG. 1; and, FIG. 6 shows the individual operating ranges of the diesel engine.

FIG. 5 shows an especially advantageous embodiment of the controller 60. The dynamic of the controller 60 can be substantially improved by utilizing a condition controller in lieu of a controller having at least a PI-response. Such a condition controller is disclosed, for example, in German published patent application 38 25 138 wherein the condition controller controls an actuator. In FIG. 5, the actual controller 60 is enclosed in the dot-dash broken line. The controller 60 supplies a quantity signal M to the control-loop segment 300 (the internal combustion engine to be controlled). The response of the control-loop segment is determined essentially by the system dead time 301 and a lag time 302.

The quantity signal M reaches an observer 303. In block 304, the observer computes a first lambda value from the quantity signal M and the air quantity QL drawn in by suction by the engine. The output signal of the air flow detector 55 acts as an air quantity signal. The observer 303 determines a second lambda value from this first lambda signal by means of a PT1-element 306 and the output signal of a proportional element 307. A dead time element 308 generates the lambda signal of the observer from the second lambda value and the output signal of the proportional element 310.

This lambda signal of the observer is compared with the measured actual lambda value in the comparison stage. This comparison signal, in turn, reaches the proportional elements (307 and 310). The proportional stage generates a quantity signal utilizing the second lambda signal. A further proportional stage 314 utilizes the measured lambda signal to obtain a quantity signal. These two quantity signals reach the summation point 316 which adds the output signal of the precontrol characteristic field 50 and the output signal of the proportional element 318 hereto. The integrator bypass 320 processes the difference of the desired lambda value and the actual lambda value.

The realization of the condition controller can be complex. A substantial improvement of the dynamic is provided by using a Smith predictor known per se. With the Smith predictor, the lambda signal is likewise observed via the quantity signal M and the air quantity QL. The fuel quantity M to be injected is changed utilizing this observed lambda signal.

In addition to controlling the lambda signal, the above principle can also be used for the control of the torque Md or the exhaust gas temperature TA. The basic principle remains the same for all variations. An operating characteristic variable can be controlled to a pregiven desired value in that a corresponding value of fuel quantity is pregiven. Such an operating characteristic variable can advantageously be the lambda value, the exhaust gas temperature TA or the torque Md. The desired value of the operating characteristic variable is then dependent upon various operating characteristic variables. In addition, the fuel quantity signal MR is influenced by a precontrol characteristic field 50. The precontrol characteristic field 50 determines the fuel quantity signal M in all operating conditions. In contrast, the controller 60 is active only in specific operating ranges. The different variations distinguish themselves essentially as to in which operating ranges the controller 60 is active. The precontrol values can be adaptively corrected in the operating conditions in which the controller 60 is active.

Figure 6:
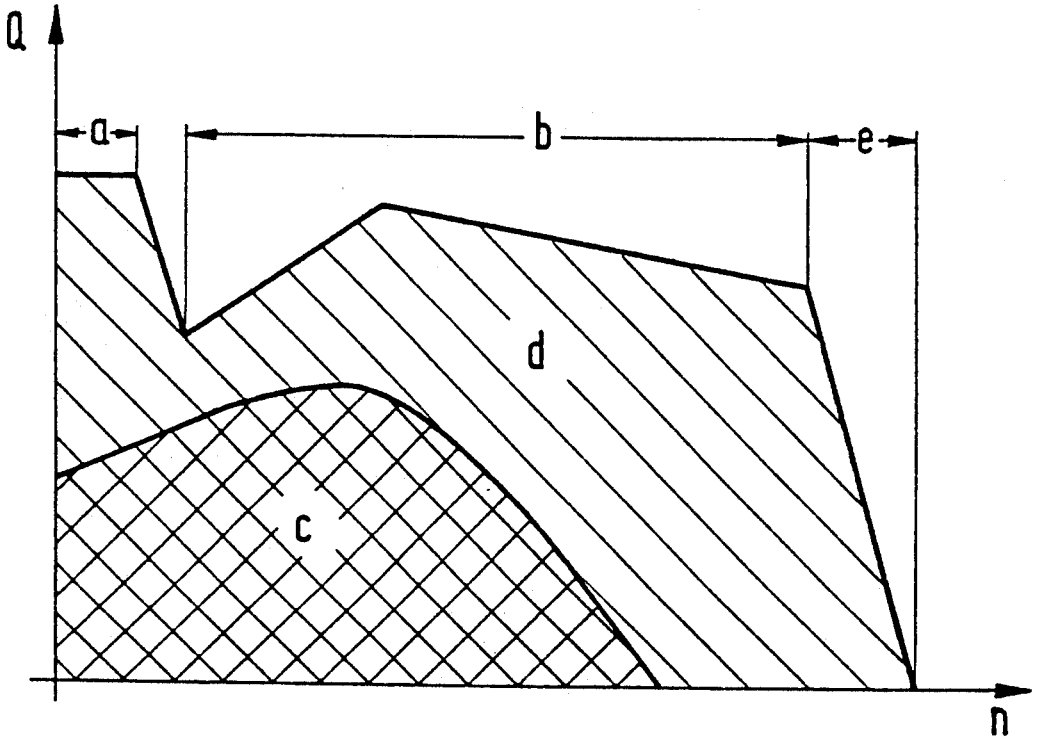

The connection between the rotational speed (n) and the injected fuel quantity Q is shown in FIG. 6 as a characteristic field. Various operating conditions are indicated in this characteristic field. In this characteristic field, (a) identifies the start range, (b) identifies the full-load range, (e) the control range, (d) the part-load range and (c) the overrun range.

If the controller 60 controls the lambda value of the exhaust gas, then the controller is preferably active in the operating ranges (b) and (d) corresponding to full-load and part-load, respectively. In the operating ranges (a, c and e), only the precontrol acts on the fuel quantity. The controller is not active in these ranges. The precontrol characteristic field 50 computes the control value for the fuel quantity in dependence upon the air quantity. This can be obtained as shown in FIG. 3. The values in the precontrol characteristic field 50 can also be called up in dependence upon the output signals R of a soot sensor or a soot characteristic field.

If the controller 60 is an exhaust gas temperature controller, then the controller is active only in the steady-state operating ranges (b and c). In contrast, the precontrol characteristic field 50 is active in all operating ranges. Especially in the operating ranges (d, a and e), only the precontrol characteristic field 50 has an influence on the fuel quantity.

The charger rotational speed nL and the charger pressure PL are input variables for the precontrol characteristic field in the operating range (b). The exhaust gas feedback rate per stroke ARR is an input variable in the operating range (c). The exhaust gas feedback rate per stroke is advantageously derived from the mix temperature and for this purpose, the respective temperature sensors for fresh air, intake air and feedback air are required.

As alternatives, the fuel quantity in the precontrol characteristic field can be stored in dependence upon the air quantity in the operating range (b). For this purpose, the air quantity can be obtained in the same manner as described for the lambda control.

As a further alternative in range (c), the precontrol values can be stored in dependence upon the lambda value of the exhaust gas. An additional overload protection is provided which is especially advantageous for the exhaust gas temperature control.

If the controller 60 is a torque controller, then the controller 60 is active in all operating ranges. The precontrol values are stored in the characteristic field 50 in dependence upon the output signal R of a soot sensor and the exhaust gas temperature. The torque is preferably measured at the take-off between the engine and transmission.

It is understood that the foregoing description is that of the preferred embodiments of the invention and that various changes and modifications may be made thereto without departing from the spirit and scope of the invention as defined in the appended claims.

What is claimed is:

1. An arrangement for making a fuel metering signal (M) available in a diesel engine starting with measured variables such as accelerator pedal position, engine speed, lambda, exhaust gas temperature, and torque, the arrangement comprising:

a precontrol characteristic field (50) for emitting a signal representing a precontrol value (MV) in dependence upon at least said engine speed;

a driving-performance characteristic field (30) for emitting a fuel-quantity request signal (MW) in dependence upon at least said accelerator pedal position;

a minimum selector (15) for supplying an output signal for determining the metering of fuel to the engine;

means for applying said signal representing said precontrol value (MV) and said fuel-quantity request signal (MW) to said minimum selector (15);

means for limiting said fuel-quantity request signal (MW) to said precontrol value; and, a controller (60);

means for causing said controller (60) to make a signal (MR) available for correcting said precontrol value (MV) for specific operating conditions of the engine in at least one of the following ways: additively and multiplicatively.

2. A method of making a fuel metering signal (M) available in a diesel engine starting with measured variables including accelerator pedal position, engine speed, lambda, exhaust gas temperature or torque, the method comprising the steps of:

emitting a signal representing a precontrol value (MV) from a precontrol characteristic field (50) in dependence upon at least said engine speed;

emitting a fuel-quantity request signal (MW) from a driving-performance characteristic field (30) in dependence upon at least said accelerator pedal position;

applying said signal representing said precontrol value (MV) and said fuel-quantity request signal (MW) to a minimum selector (15) which, in turn, supplies an output signal for determining the metering of fuel to the engine;

limiting said fuel-quantity request signal (MW) to said precontrol value (MV); and, causing a controller (60) to make a signal (MR) available for correcting said precontrol value (MV) for specific operating conditions of said engine in at least one of the following ways: additively and multiplicatively.

3. The method of claim 2, wherein said signal emitted by said precontrol characteristic field (50) is adaptively adapted in dependence upon said signal (MR) of said controller (60) during said specific operating conditions.

4. The method of claim 2, wherein said controller (60) is an active controller, and the values stored in said precontrol characteristic field (50) are changed in dependence upon said signal (MR) of said controller (60).

5. The method of claim 2, wherein said signal emitted by said precontrol characteristic field (50) are corrected in at least one of the following ways: additively and multiplicatively.

6. The method of claim 2, wherein one of the following variables are controlled: exhaust gas temperature, torque and the lambda value of the exhaust gas.

7. The method of claim 2, wherein said controller (60) is active at full load for the lambda value of the exhaust gas.

8. The method of claim 2, wherein said controller (60) is an exhaust-gas temperature controller and is active only in steady-state operating regions.

9. The method of claim 2, wherein said controller (60) is a torque controller and is active in all operating regions.

10. The method of claim 2, wherein the desired lambda value is dependent upon engine speed.

11. The method of claim 2, wherein the values of the precontrol characteristic field (50) depend upon the air quantity drawn in by suction, said air quantity being measured by means of an air-flow sensor or computed by means of a simulation.

12. The method of claim 11, wherein the air quantity drawn in by suction is simulated with the aid of the derivative of engine speed and the injected fuel quantity.

13. A method of making a fuel metering signal (M) available in a diesel engine starting with measured variables including accelerator pedal position, engine speed, lambda, exhaust gas temperature or torque, the method comprising the steps of:

providing a first signal (MW) indicative of a preselected fuel-quantity request dependent upon accelerator pedal position;

providing a second signal (MV) taken from a precontrol characteristic field (50) and dependent upon engine speed;

applying said first and second signals (MW and MV) to a minimum selector which, in turn, supplies an output signal determining the metering of the fuel;

influencing said second signal (MV) with the signal (MR) of a controller (60) with respect to a variable to be controlled during specific operating conditions;

the values of the precontrol characteristic field (50) depending upon the air quantity (QL) drawn in by suction, said air quantity being arrived at by one of the following:

measuring by means of an air-flow sensor and computing by means of a simulation;

the air quantity (QL) being computed from the temperature (TL) and the pressure (PL) of the intake air wherein one of the following applies:

(a) the pressure (PL) and the temperature (TL) are measured;

(b) the course of the pressure is derived from the measured course of the temperature; and, (c) the course of the temperature is derived from the measured course of the pressure;

with the temperature signal being precontrolled in dependence upon the pressure signal (PL) in the case of a slow temperature sensor.

14. The method of claim 2, wherein the output signal of the controller (60) is preserved when the quantity request drops below the signal (MR) of the controller.

15. The method of claim 14, wherein said preserved signal is modified.

16. The method of claim 2, wherein the control parameters are controlled.

17. The method of claim 2, wherein: said controller (60) is a controller having at least a PI-response; and, a condition controller or a Smith Predictor is used as controller (60).

18. The method of claim 2, wherein the signal of the precontrol characteristic field (50) is delayed under specific conditions.

* * * * *